US007137823B2

(12) United States Patent
Naganishi

(10) Patent No.: US 7,137,823 B2
(45) Date of Patent: Nov. 21, 2006

(54) APPARATUS EQUIPPED WITH ELECTRONIC CONTROL UNITS

(75) Inventor: Yukinari Naganishi, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/988,620

(22) Filed: Nov. 16, 2004

(65) Prior Publication Data

US 2005/0112940 A1 May 26, 2005

(30) Foreign Application Priority Data

Nov. 21, 2003 (JP) ..... P2003-391813

(51) Int. Cl.
*H01R 33/00* (2006.01)

(52) U.S. Cl. ..... 439/34; 439/949

(58) Field of Classification Search ..... 439/34, 439/76.1, 76.2, 74, 949
See application file for complete search history.

(56) References Cited

U.S. PATENT DOCUMENTS 6,690,582 B1 * 2/2004 Sumida ..... 361/752

FOREIGN PATENT DOCUMENTS

JP 6-97683 A 4/1994
JP 2003-304083 A 10/2003

* cited by examiner

*Primary Examiner*—Javaid H. Nasri
(74) *Attorney, Agent, or Firm*—Sughrue Mion, PLLC

(57) ABSTRACT

Each of electronic control units is configured to control electronic components in a vehicle, and is provided with a plurality of first terminals classified into a plurality of groups each of which is associated with electronic components in one of sections in the vehicle. A board has a first face on which the electronic control units are mounted. First connectors are provided on a second face of the board. Each of the first connectors has second terminals each of which is electrically connected to one of the first terminals in one of the groups in each of the electronic control units, and is configured to be connected to a wire harness extended to one of the sections in the vehicle.

7 Claims, 2 Drawing Sheets

APPARATUS EQUIPPED WITH ELECTRONIC CONTROL UNITS

BACKGROUND OF THE INVENTION

The present invention relates to an apparatus equipped with a plurality of electronic control units (ECUs) for controlling electronic equipments in a vehicle.

A vehicle is provided with an electronic control unit (ECU) for air conditioning which serves to control the air conditioning in a vehicle compartment, an ECU for an ABS (anti-locking braking system) which serves to prevent a wheel from slipping, an ECU for an air bag which serves to expand the air bag in a collision, an ECU for injecting a fuel which serves to control the amount of jet of a fuel or other various ECUs, for example. Conventionally, these ECUs are provided in spaces in the vicinity of electronic equipment to be controlled, for example, an instrument panel, an engine room or a vehicle compartment.

A plurality of ECUs are disposed in separate spaces in a vehicle, and are respectively connected to an electronic equipment or a sensor to be controlled through a wire harness. For this reason, the number of the wire harnesses to be installed in the vehicle is increased.

Furthermore, each of the ECUs is attached to a vehicle body through a bracket. Consequently, the number of the brackets to be provided in the vehicle is also increased. For this reason, there is a problem in that a weight is increased by the bracket and a burden to a work for attaching the wire harness or the bracket is increased. In view of the above, it is proposed that a plurality of ECUs are mounted on one mother board (cf., Japanese Patent Publication Nos. 6-97683A and 2003-304083A).

In the configuration disclosed in Japanese Patent Publication No. 6-97683A, only one connector is provided for a plurality of ECUs mounted on one board. Therefore, the wire harness connected to the board has to be branched to be electrically connected to every position (destination) in a vehicle (for example, an instrument panel, an engine room, and a vehicle compartment). For this reason, there is a problem in that the wire harness becomes complicated.

In the configuration disclosed in Japanese Patent Publication No. 2003-304083A, a connector is provided for each of ECUs mounted on a board. For this reason, the connector is to be connected corresponding to the number of the ECUs mounted on the board. Consequently, the burden to the work for attaching the wire harness to the board is increased. Moreover, it is necessary to cause the wire harness to branch to be electrically connected to every position (destination) in a vehicle. Consequently, there is also a problem in that the wire harness becomes complicated.

SUMMARY OF THE INVENTION

It is therefore an object of the invention to provide an apparatus equipped with a plurality of ECUs (hereinafter, referred as "ECU apparatus") which is capable of relieving a burden to a work for attaching wire harnesses to be connected to the ECUs without complicating the wire harness.

In order to achieve the above object, according to the invention, there is provided an apparatus, comprising:

a plurality of electronic control units, each of which is configured to control electronic components in a vehicle, and is provided with a plurality of first terminals classified into a plurality of groups each of which is associated with electronic components in one of sections in the vehicle;

a board, having a first face on which the electronic control units are mounted; and a plurality of first connectors, provided on a second face of the board which is opposite to the first face, each of the first connectors having second terminals each of which is electrically connected to one of the first terminals in one of the groups in each of the electronic control units, and being configured to be connected to a wire harness extended to one of the sections in the vehicle.

With this configuration, it is necessary to branch the wire harness connected to each of the first connectors so as to extend to the respective sections in the vehicle. In addition, the number of attaching operations of the wire harnesses to the first connectors can be made coincident with the number of the groups. Accordingly, it is possible to relieve the burden of the wiring operation without complicating each of the wire harnesses.

Preferably, the sections include an instrument panel, an engine room and a vehicle compartment.

Preferably, a plurality of second connectors are provided on the first face of the board. Each of the second connectors has at least one third terminal configured to be connected to at least one of the first terminals in first one of the groups in each of the electronic control units. The third terminal extends through the board and serves as one of the second terminals in first one of the first connectors.

With this configuration, the second connectors and the first one of the first connectors are opposed to each other through the board, thereby the size of the board can be reduced.

Here, it is preferable that the first terminals in each of the electronic control units which are not classified into the first one of the groups are arranged so as not to oppose to the first one of the first connectors.

Preferably, a separate terminal is provided in at least one of the electronic control units and configured to be connected to an electric wire which is different from the wire harness.

With this configuration, the electric wire different from the wire harness is connected to the electronic control unit without through the board. Accordingly, it is possible to easily reduce the affection of noises from the electric wire to the board.

Here, it is preferable that the first terminals and the separate terminal are provided on the same face of the at least one of the electronic control units.

With this configuration, the wire harness and the electric wire can be attached to the electronic control unit from the same side. Accordingly, it is possible to relieve the burden of the wiring operation.

Preferably, a cover member is disposed on the first face of the board to partition each of the electronic control units.

With this configuration, the mounting operation of the electronic control units can be facilitated.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
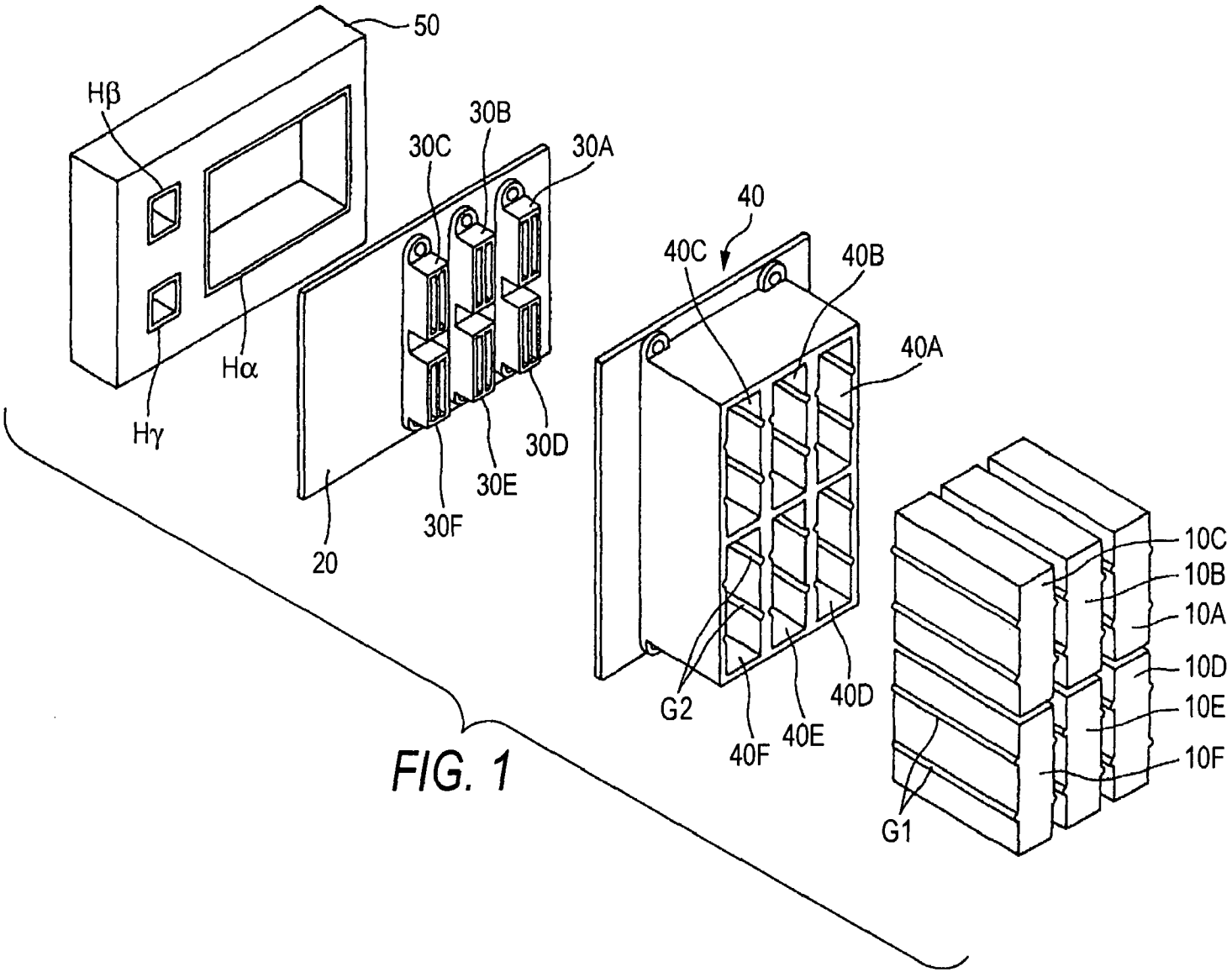
FIG. 1 is a perspective view showing a disassembled state of an apparatus according to one embodiment of the invention.

One embodiment of the invention will be described below in detail with reference to the accompanying drawings. As shown in FIG. 1, the ECU apparatus comprises: six ECUs 10A to 10F for controlling electronic equipments in a vehicle; and a board 20 on which the ECUs 10A to 10F are to be mounted. A plurality of connecting terminals which are not shown are provided on the board 20 side of the ECUs 10A to 10F, respectively.

The connecting terminals are classified by positions in a vehicle (destinations) that the connecting terminals are to be electrically connected. In the embodiment, description will be given to a case where the classification is carried out into three groups including connecting terminals to be electrically connected to an instrument panel, connecting terminals to be electrically connected to an engine room and connecting terminals to be electrically connected to a vehicle compartment.

ECU-side connectors 30A to 30F to which the ECUs 10A to 10F are to be connected are mounted on the board 20. Furthermore, an upper cover (housing box) 40 having chambers 40A to 40F for partitioning the six ECUs 10A to 10F is mounted on the board 20.

Guide ribs G1 are formed on side faces of each of the ECUs 10A to 10F, while guide grooves G2 are formed on inner faces of each of the housing chambers 40A to 40F. When the ECUs 10A to 10F are inserted into the chambers 40A to 40F while fitting the guide ribs G1 into the guide grooves G2, the connecting terminals of the ECUs 10A to 10F are inserted into female terminals provided in the ECU-side connectors 30A to 30F.

By providing the upper cover 40 described above, it is possible to simply insert the ECUs 10A to 10F into the chambers 40A to 40F, thereby connecting the ECUs 10A to 10F to the ECU-side connectors 30A to 30F easily without aligning the ECUs 10A to 10F with the ECU-side connectors 30A to 30F. Consequently, the ECUs 10A to 10F can easily be mounted on the board 20.

Figure 2:
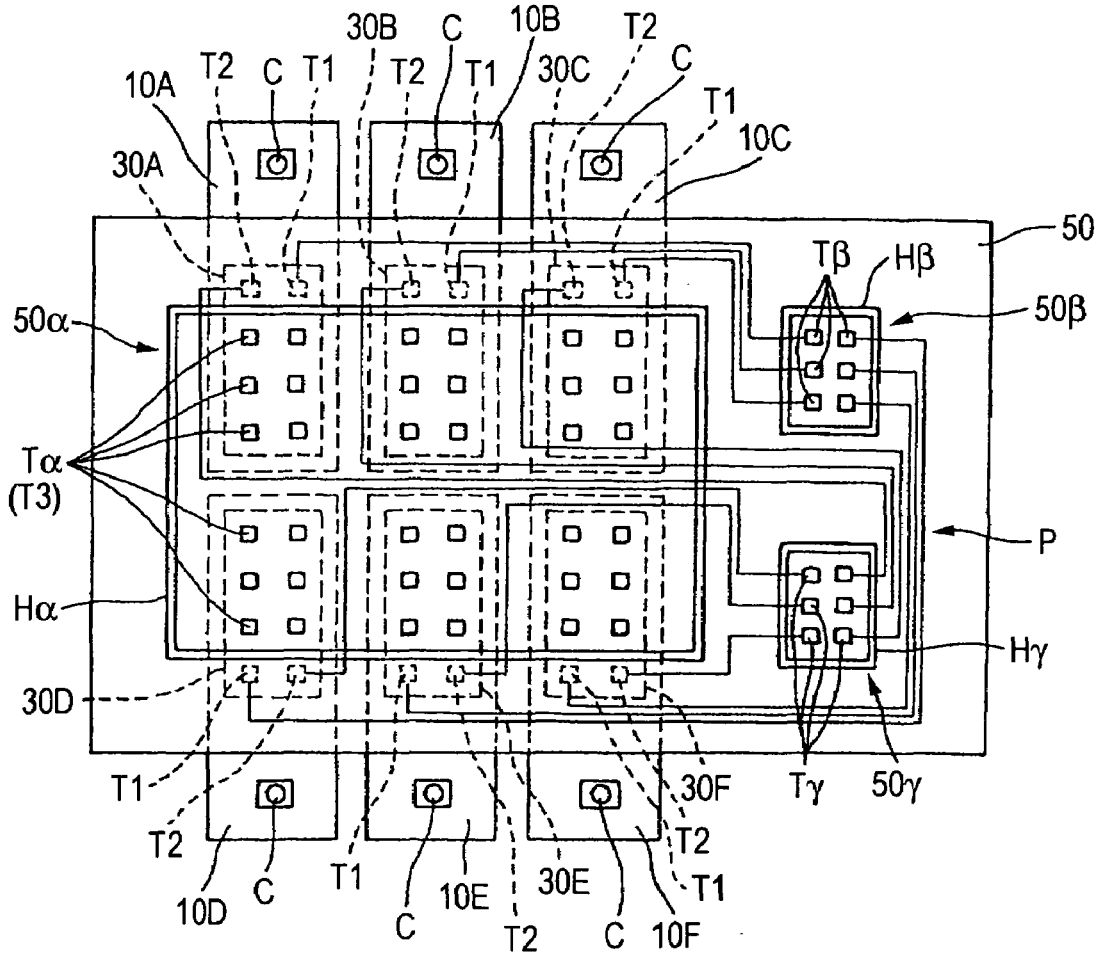
FIG. 2 is a schematic plan view showing wirings in the apparatus of FIG. 1.

Components to be mounted on a back face of the board 20 will be described below with reference to FIG. 2. Here, a surface on which the ECU-side connectors 30A to 30F are mounted is defined as a front face of the board 20, and an opposed surface to the front face is defined as the rear face of the board 20. In FIG. 2, dashed lines depict the ECU-side connectors 30A to 30F and the ECUs 10A to 10F which are provided on the front face of the board 20.

As depicted by solid lines in FIG. 2, harness-side connectors 50α, 50β and 50γ to which a wire harness is connected are mounted on the rear face of the board 20. The harness-side connectors 50α, 50β and 50γ are constituted by male terminals Tα, Tβ and Tγ mounted on the rear face of the board 20, and housings Hα, Hβ and Hγ accommodated in an lower cover 50 provided on the rear face side of the board 20 as shown in FIG. 1, respectively. The harness-side connector 50α is for connection to the instrument panel, the harness-side connector 50β is for connection to the engine room, and the harness-side connector 50γ is for connection to the vehicle compartment.

In FIG. 2, a wiring pattern P depicted by narrow lines is provided on the front face of the board 20 in such a manner that: female terminals T1 in each of the ECU-side connectors 30A to 30F and male terminals Tβ in the harness-side connector 50β to be electrically connected to components in the engine room are connected; and female terminals T2 in each of the ECU-side connectors 30A to 30F and male terminals Tγ in the harness-side connector 50γ to be electrically connected to components in the vehicle compartment are connected.

Figure 3:
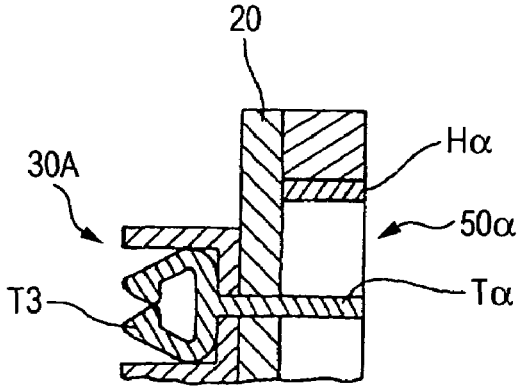
FIG. 3 is a partial section view of a connector mounted on a board in the apparatus of FIG. 1.

Furthermore, as shown in FIG. 3, female terminals T3 in each of the ECU-side connectors 30A to 30F are extended through the board 20 so as to project into the housing Hα of the harness-side connector 50α to serve as male terminals Tα to be electrically connected to components in the instrument panel.

A wire harness extended to the instrument panel is connected to the harness-side connector 50α, so that electrical connection is established between some of terminals in each of the ECUs 10A to 10F and the components in the instrument panel.

A wire harness extended to the engine room is connected to the harness-side connector 50β, so that electrical connection is established between some of terminals in each of the ECUs 10A to 10F and the components in the engine room.

A wire harness extended to the vehicle compartment is connected to the harness-side connector 50γ, so that electrical connection is established between some of terminals in each of the ECUs 10A to 10F and the components in the vehicle compartment.

Since the ECUs 10A to 10F are mounted on the board 20, the brackets for attaching the ECUs to the vehicle body are not necessary.

Since the terminals in each of the ECUs 10A to 10F are classified into three groups in accordance with parts of a vehicle to be electrically connected, and each of the harness-side connectors 50α, 50β and 50γ is provided so as to correspond to one of the groups, it is not necessary to branch a wire harness so as to extend toward the respective parts of the vehicle. In addition, the number of the connecting operations can be made coincident with the number of groups (i.e., three times in this embodiment). Therefore, it is possible to relieve a burden to the connecting operations of the wire harnesses to the ECUs 10A to 10F without complicating each of the wire harnesses.

Since the female terminals T3 in each of the ECU-side connectors 30A to 30F are configured as described the above, the harness-side connectors 50α can be arranged so as to oppose to the ECU-side connectors 30A to 30F through the board 20. It contributes the size reduction of the board 20.

In order to arrange the harness-side connectors 50α, 50β and 50γ efficiently within a limited space, as shown in FIG. 2, the female terminals T3 are gathered such that the housing Hα does not oppose to the female terminals T1 and T2, thereby reducing the size of the housing Hα of the harness-side connector 50α.

As shown in FIG. 2, a connector C for the connection to a coaxial cable which is different from the wire harness is provided on the same face of each of the ECUs 10A to 10F as the face that the terminals are provided. The connector C is arranged so as not to oppose to the board 20.

With this configuration, the coaxial cables are connected to the ECUs 10A to 10F without through the board 20, thereby reducing the affection of noises from the coaxial cable to the board 20.

Furthermore, since the coaxial cables and the wire harnesses are attached from the same side, it is possible to relieve the burden to the attaching work.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An apparatus, comprising:

a plurality of electronic control units, each of which is configured to control electronic components in a vehicle, and is provided with a plurality of first terminals classified into a plurality of groups each of which is associated with electronic components in one of sections in the vehicle;

a board, having a first face on which the electronic control units are mounted; and a plurality of first connectors, provided on a second face of the board which is opposite to the first face, each of the first connectors having second terminals each of which is electrically connected to at least one of the first terminals in one of the groups in one of the electronic control units, wherein all of the second terminals in one of the first connectors are electrically connected to a wire harness extended to one of the sections in the vehicle.

2. The apparatus as set forth in claim 1, wherein the sections include an instrument panel, an engine room and a vehicle compartment.

3. The apparatus as set forth in claim 1, further comprising a plurality of second connectors provided on the first face of the board, each of the second connectors having at least one third terminal configured to be connected to at least one of the first terminals in first one of the groups in each of the electronic control units, wherein the third terminal extends through the board and serves as one of the second terminals in first one of the first connectors.

4. The apparatus as set forth in claim 3, wherein the first terminals in each of the electronic control units which are not classified into the first one of the groups are arranged so as not to oppose to the first one of the first connectors.

5. The apparatus as set forth in claim 1, further comprising a separate terminal provided in at least one of the electronic control units and configured to be connected to an electric wire which is different from the wire harness.

6. The apparatus as set forth in claim 5, wherein the first terminals and the separate terminal are provided on the same face of the at least one of the electronic control units.

7. The apparatus as set forth in claim 1, further comprising a cover member disposed on the first face of the board to partition each of the electronic control units.

* * * * *